US005991240A

United States Patent [19]

Van Ryzin

[11] Patent Number: 5,991,240

[45] Date of Patent: Nov. 23, 1999

[54] ALARM CLOCK WITH AUTOMATIC TIME/ DATE SETTING FEATURE

[75] Inventor: John M. Van Ryzin, Madison, N.J.

[73] Assignees: Sony Corporation, Tokyo, Japan; Sony Electronics, Inc., Park Ridge, N.J.

[21] Appl. No.: 09/017,791

[22] Filed: Feb. 3, 1998

[51] Int. Cl.[6] ..... G04C 11/02

[52] U.S. Cl. ..... 368/47

[58] Field of Search ..... 368/47, 46

[56] References Cited

U.S. PATENT DOCUMENTS

| | | | |
|---|---|---|---|
| 5,334,975 | 8/1994 | Wachob et al. | 368/46 |
| 5,621,458 | 4/1997 | Mann et al. | 368/41 |
| 5,737,692 | 4/1998 | Lang | 368/244 |

*Primary Examiner*—Bernard Roskoski

*Attorney, Agent, or Firm*—Frommer Lawrence & Haug, LLP.; William S. Frommer

[57] ABSTRACT

An alarm clock which automatically sets current time and date by receiving a television broadcast signal or the like and by decoding a signal included in the received television broadcast signal to obtain the current time and date information. A programmable controller processes the current time and date information for display. The alarm clock further includes a memory for storing data representing holidays. The programmable controller is operative to activate an alarm trigger in response to a user setting and to disable the user setting if it is determined that the current date coincides with one of the holidays stored in the memory.

6 Claims, 1 Drawing Sheet

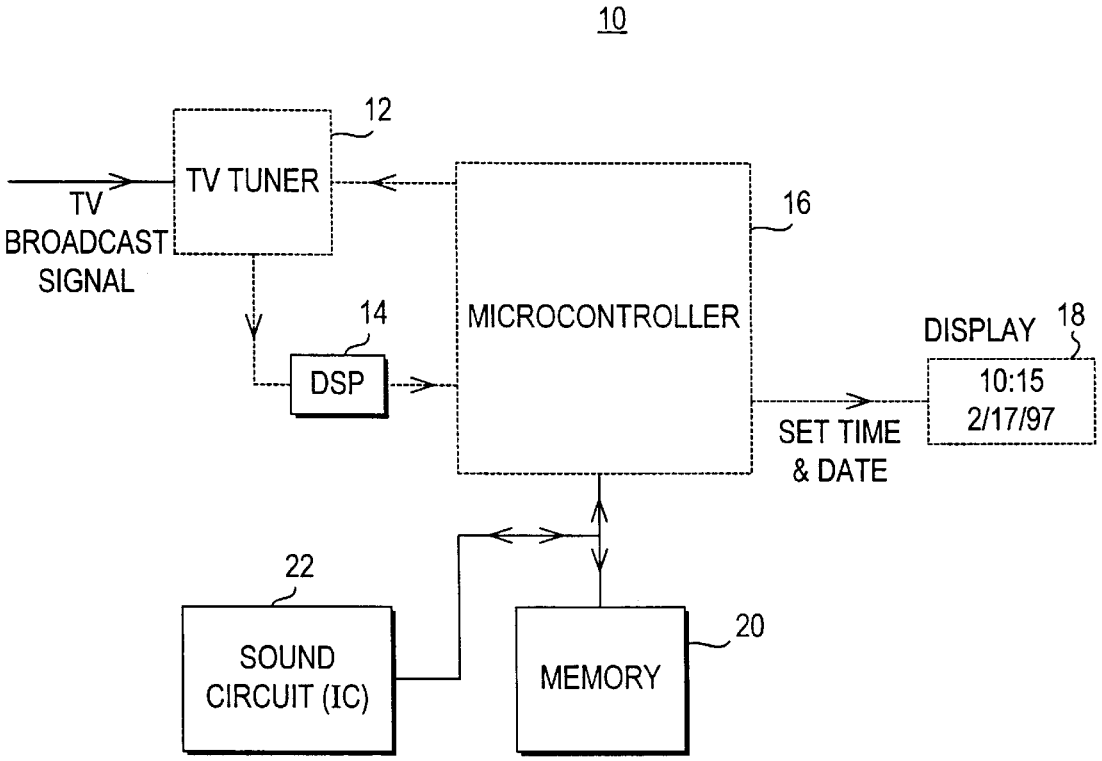
10
12
TV TUNER
TV
BROADCAST
SIGNAL
16
MICROCONTROLLER
14
DSP
DISPLAY
18
10:15
2/17/97
SET TIME
& DATE
22
SOUND
CIRCUIT (IC)
MEMORY
20

ALARM CLOCK WITH AUTOMATIC TIME/ DATE SETTING FEATURE

BACKGROUND OF THE INVENTION

The present invention is related to signal processing and, in particular, to an alarm clock for automatically setting time/date based on a television broadcast signal transmitted by television broadcast stations.

Conventional electronic alarm clocks come with several features. For example, it is known that when an alarm is triggered instead of a conventional buzzer, a radio station may be tuned. In such clock/radios, the volume of the selected radio station gradually increases after the alarm is triggered if the alarm device is not turned off immediately. Another feature typically found in alarm clocks of this type is battery-backup. A 9-volt battery, for example, provides power to the internal circuits in the alarm clock during power outage.

While the above features certainly add convenience as well as combine the utilitarian features of alarm clocks with entertainment, such alarm clocks lack the feature of automatically setting time and/or date. Namely, when a new alarm clock is purchased, it has to be set to the correct time. In addition, the alarm clock has to be adjusted for daylight savings time, different time zones, and the like. Further, some people do not change the back-up battery, and when a power outage occurs, the blinking "12:00" has to be set to the correct time.

A need therefore exists for an alarm clock that overcomes the above disadvantages.

OBJECTS OF THE INVENTION

It is an object of the present invention to provide an alarm clock in which time and date are automatically set.

It is another object of the present invention to provide an alarm clock in which an alarm trigger is automatically disabled during holidays and on weekends.

It is a further object of the present invention to provide an alarm clock in which a musical recording related to an upcoming holiday is played automatically.

SUMMARY OF THE INVENTION

These and other objects, features and advantages are accomplished by an alarm clock in which current time and date information is set automatically. The alarm clock comprises a tuner for receiving a television broadcast signal; a digital signal processor for receiving the received television broadcast signal and for decoding a signal included in the received television broadcast signal to obtain the current time and date information; a programmable controller for processing the current time and date information received from the digital signal processor; and a display for displaying the current time and date information received from the programmable controller.

In accordance with one aspect of the present invention, the alarm clock further includes a memory for storing data representing holidays. The programmable controller, being operative to activate an alarm trigger in response to a user setting, disables the user setting if the programmable controller determines that the current day coincides with one of the holidays stored in the memory.

In accordance with another aspect of the present invention, a sound circuit for storing musical tunes is provided. The programmable controller, in addition to being operative to activate the alarm trigger in response to the user setting, reproduces one of the musical tunes when the alarm trigger is triggered if the programmable controller determines that the current day coincides with the holiday.

BRIEF DESCRIPTION OF THE DRAWINGS

The above-mentioned as well as additional objects, features and advantages of the present invention will become readily apparent from the following detailed description thereof which is to be read in conjunction with the accompanying drawing, in which:

The FIGURE is a block diagram of an alarm clock in which date/time is set automatically in accordance with the present invention.

DETAILED DESCRIPTION OF THE PREFERRED EMBODIMENTS

The FIGURE shows a block diagram of the alarm clock 10 in accordance with the present invention. A TV tuner 12 for receiving a television broadcast signal is connected to a digital signal processor (DSP) 14 for processing digital signals. The digital signal processor 14 is connected to a microprocessor (microcontroller) 16 for controlling the overall operation of the alarm clock 10, including a display 18 and a memory 20. The memory 20 stores data and control programs executable by the microprocessor 16 and digital signal processor 14, and the display 18 displays current date and time under control of the microprocessor 16.

In operation, the TV tuner 12 uses information that normally is broadcast with television signals to automatically set the date and time in the alarm clock 10 as follows. It is known that certain television signals contain date and time information that is periodically broadcast in TV signals. In particular, line 21 of the television broadcast signal sometimes has time and date information inserted by a broadcasting station during the vertical blanking period. The TV tuner 12 is operative to receive a television broadcast signal and scans the communications medium for the presence of this TV signal. If the television broadcast signal is detected, the TV tuner 12 supplies the received signal to the digital signal processor 14 which converts the received analog data to digital form and extracts that data that is present in line 21 of the television broadcast signal. Then, the digital signal processor 14 determines whether this line 21 data contains date/time information. If such information is not present, the digital signal processor notifies the microprocessor 16 of the lack of such information; and the microprocessor directs the TV tuner 12 to continue its operation of detecting the television broadcast signal.

If, however, the date/time information is present in line 21 of the television broadcast signal, this information is extracted and decoded by the digital signal processor 14. The decoded information is supplied to the microprocessor 16 which performs appropriate processing operations in order to display date and time on the display 18. As is apparent from the above description, the alarm clock 10 in accordance with the present invention automatically sets date and time using a simple and inexpensive modification of existing alarm clocks.

In accordance with another aspect of the present invention, a holiday date list including, for example, all major holidays as well as other unofficial holidays such as St. Valentine's Day is stored in the memory 20. A "Holiday" key (not shown) on the alarm clock 10 allows the user to skip the alarm trigger for the next morning and resume normal operation the day after the holiday. That is, the microprocessor compares the current date to the stored holiday date list and based on the comparison either overrides the alarm trigger if the next day is one of the holidays on the list, or leaves the alarm trigger for the next day unchanged.

In accordance with yet another aspect of the present invention, a calendar is stored in the memory 20. The microprocessor 16 compares the received date/time information with the calendar information stored in memory 20. Similar to the "Holiday" key, by activating a "Weekend" key (not shown) on the alarm clock 10, the user automatically disables the alarm function for weekends only. That is, if following the comparison, the microprocessor 16 determines that the current date falls on Sunday, for example, the alarm trigger is disabled for that day.

In accordance with still another aspect of the present invention, a calendar (i.e. data representing a calendar year) and a holiday list are stored in the memory 20. The microprocessor 16 determines whether the current date as received from the digital signal processor 14 is a holiday or weekend by comparing the received date to the stored list, and displays the text string "holiday" or "weekend" on the display 18. The microprocessor 16 may further be programmed in such a way that the text string may be displayed N number of days in advance of the actual holiday. For example, the microprocessor 16 by checking against the calendar information in the memory 20, determines that Halloween is in 5 days. Then, such information, that is "Halloween in 5 days", is displayed on the display 18.

In accordance with a still further aspect of the present invention, the alarm clock may include a sound circuit (IC) 22 to play musical tunes related to an upcoming holiday when the alarm is triggered. As shown in the FIGURE, the sound circuit 22 is connected to the microprocessor 16 for playing various tunes stored in the memory 20 as a lookup table of notes. For example, if it is three days before Christmas, as determined by the microprocessor 16 by comparing the received date with the calendar information in the memory 20, the microprocessor 16 accesses the lookup table in the memory 20 to play "Jingle Bells" when the alarm is triggered. Such musical alarm continues until December 26, for example, and then is replaced by New Year music.

It is understood, of course, that the FIGURE only representatively shows the alarm clock 10 in accordance with the present invention containing a separate memory. Alternatively, an on-board (internal) memory in the microprocessor 16 may be used based on the requirements and desired functions of the alarm clock 10. Also, if time and date information are included in broadcasted signals other than TV signals, tuner 12 need not be a TV tuner and may simply tune to the broadcasted signal.

Having described specific preferred embodiments of the invention with reference to the accompanying drawings, it is to be understood that the invention is not limited to those precise embodiments, and that various changes and modifications may be effected therein by one skilled in the art without departing from the scope or the spirit of the invention as defined in the appended claims.

What is claimed is:

1. An alarm clock in which current time and date information are set automatically, comprising:

a tuner for receiving a broadcast video signal;

a digital signal processor for receiving the received broadcast signal and for decoding a signal included in a vertical blanking period of the received broadcast signal to obtain said current time and date information;

a programmable controller for processing said current time and date information received from said digital signal processor to set the current time and date;

a memory for storing data representing a plurality of holidays, said programmable controller activating an alarm trigger in response to a user setting and disabling said user setting if said programmable controller determines that the current date coincides with one of the holidays stored in said memory; and a display for displaying said current time and date information received from said programmable controller.

2. The device according to claim 1, wherein said programmable controller is operative to display said holiday on said display.

3. The device according to claim 2, wherein said holiday is displayed on said predetermined day.

4. The device according to claim 1, wherein said memory stores data representing a calendar year, and wherein said programmable controller is operative to activate an alarm trigger in response to another user setting and to enable said another user setting if said programmable controller determines that the current date coincides with a workday based on said data retrieved from said memory.

5. The device according to claim 4, wherein said programmable controller is operative to disable said user setting if said programmable controller determines that said current date coincides with a holiday based on said data retrieved from said memory.

6. The device according to claim 1, further comprising a sound circuit for storing a plurality of musical tunes, and wherein said programmable controller is operative to activate an alarm trigger in response to another user setting and to reproduce one of the musical tunes related to one of the holidays when said alarm trigger is triggered if said programmable controller determines that the current date coincides with said one holiday.

* * * * *